United States Patent [19]

Barnes et al.

[11] 4,062,296

[45] Dec. 13, 1977

[54] DRIVE TRUCKS

[75] Inventors: Arthur K. Barnes; H. T. Stevens, both of Alliance, Ohio

[73] Assignee: The Alliance Machine Company, Alliance, Ohio

[21] Appl. No.: 703,895

[22] Filed: July 9, 1976

[51] Int. Cl.[2] ..... B61C 9/48

[52] U.S. Cl. ..... 105/163 R; 74/209; 105/112

[58] Field of Search ..... 105/112, 224 R, 224 A, 105/163 R, 163 A; 74/209

[56] References Cited

U.S. PATENT DOCUMENTS

| | | | |
|---|---|---|---|
| 450,652 | 4/1891 | Westinghouse | 105/112 |
| 644,440 | 2/1900 | McElroy | 74/209 X |

*Primary Examiner*—Robert G. Sheridan

*Attorney, Agent, or Firm*—Buell, Blenko & Ziesenheim

[57] ABSTRACT

A bridge truck assembly for cranes and the like is provided having at least two in-line wheels on a side engaging a trackway, a prime mover drivingly connected to one wheel and a pair of rotatable drive members engaging the circumference of both said in-line wheels on opposite sides of the center line between them and urged together into engagement with said wheels by resilient means.

6 Claims, 2 Drawing Figures

DRIVE TRUCKS

This invention relates to drive trucks and particularly to friction drive trucks for soaking pit cranes and like devices.

Soaking pit cranes and similar cranes are generally supported on wheeled trucks in which at least one wheel of at least two trucks on opposite sides of the crane is driven so as to move the crane along a rail. In most instances the wheeled trucks have two closely associated wheels in tandem and it is generally desirable to drive both wheels because of the better traction which can be achieved thereby. In the past, in order to drive both wheels, it has been the practice to connect the axles with intricate gear trains which are costly or to drive individually each wheel with synchronous drive motors which is also costly.

The present invention provides a simple and highly effective solution to this problem by the expedient of driving one wheel of a pair of in-line wheels on one side of a truck with a prime mover such as an electric motor and connecting the second wheel thereto by means of a friction drive assembly in the form of two opposing spring loaded rollers, one on each side of the center line between the two wheels. The rollers are in constant contact with the two in-line wheels and the horizontal force which would tend to spread the wheel is reduced to provide a practical operative solution.

This invention comprises a bridge truck for cranes and the like having at least two in-line wheels on a side adapted to engage a trackway, a prime mover drivingly connected to one of said wheels, a pair of rotatable drive members engaging both said in-line wheels between them and on opposite sides of the center line between said wheels and resilient means acting on said rotatable drive members urging them toward said center line and into engagement with both wheels. Preferably the rotatable drive means are two friction rollers journaled on shafts mounted at each end in a housing depending from the truck body and urged together by coil springs. The driven wheel and prime mover arrangement may be any of the known arrangements, e.g., U.S. Pat. Nos.3,252,586; 3,543,690.

Figure 2:
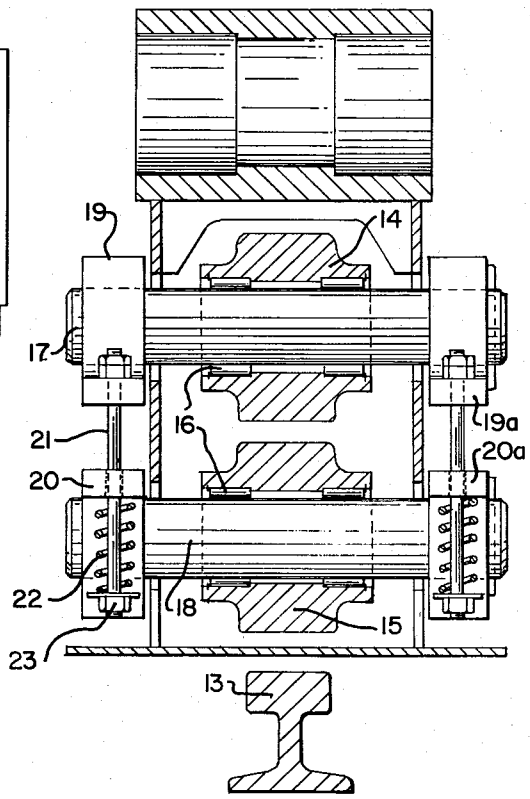
Figure 1:
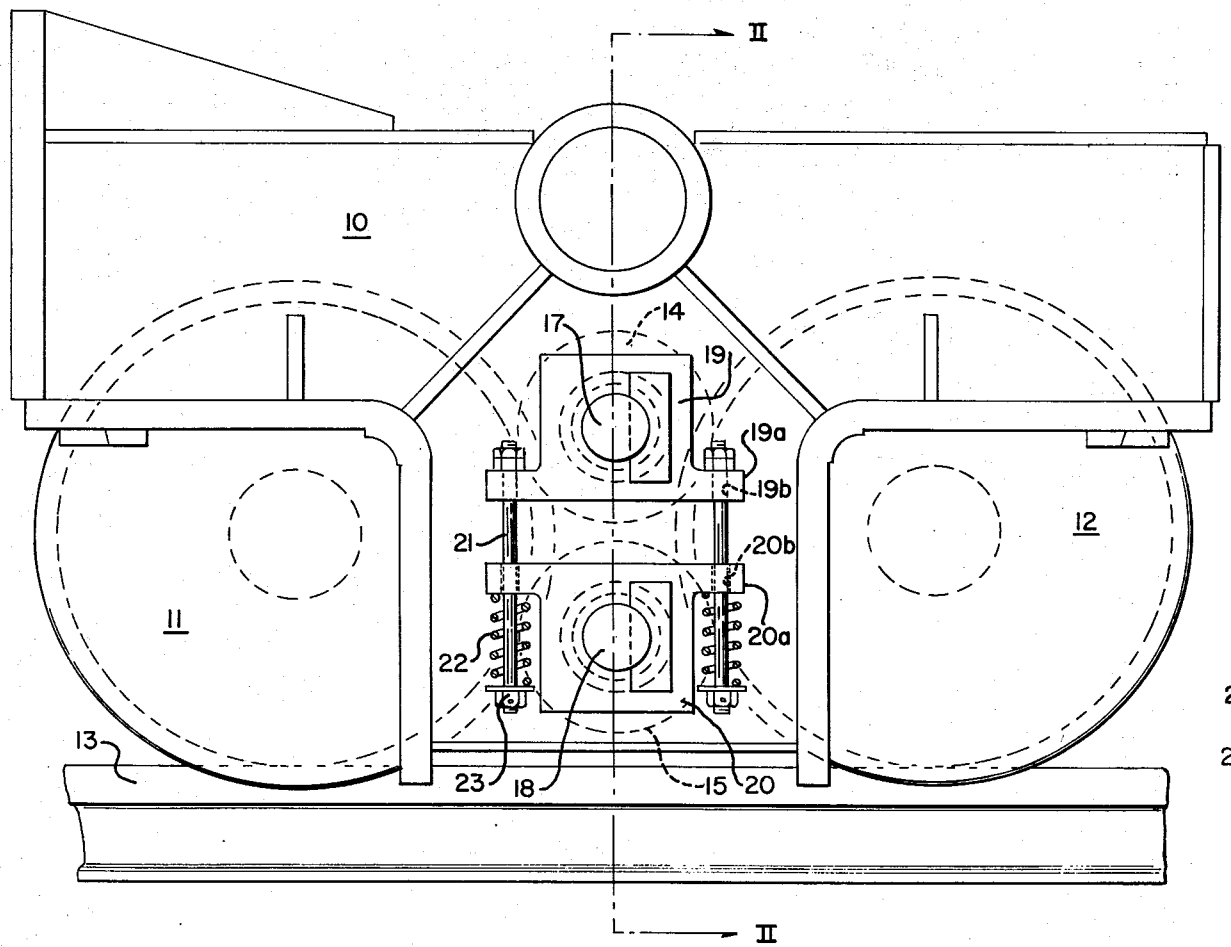

In the foregoing general description certain objects, purposes and advantages of this invention have been set out. Other objects, purposes and advantages of this invention will be apparent from a consideration of the following description and the accompanying drawings in which:

FIG. 1 is a side elevational view of a truck assembly according to this invention; and FIG. 2 is a section on the line II—II of FIG. 1.

Referring to the drawings there is illustrated a carrier frame 10 adapted to be carried by a truck frame between in-line wheels 11 and 12 which are adapted to run on track 13. Upper 14 and lower 15 rollers are journaled on bearings 16 and shafts 17 and 18 one above and one below the horizontal center line between wheels 11 and 12. The shafts 17 and 18 are fixed at each end in upper bracket blocks 19 and lower bracket blocks 20. Each of bracket blocks 19 and 20 are provided with horizontal flanges **19*a* and 20*a* having openings 19*b* and 20*b* through which bolts 21 pass. A coil spring 22 is provided between one end of each bolt 22 and the adjacent flanges 19*a* and 20*a* to urge the bracket blocks 19 and 20 toward each other under resilient force. The amount of this force can be varied by tightened or loosening nuts 23. The two rollers 14 and 15 bear on wheel rims 11 and 12. A prime mover is connected to one of wheels 11 and 12 (e.g. 11) to drive it. The other wheel, e.g. 12, is then frictionally driven by rollers 14 and 15 bearing on both wheel rims 11 and 12**.

This assembly provides a very simple means of providing synchronous driving to two in-line wheels, only one of which is driven. It can be used, not only on new truck construction but can be readily adapted to old truck assemblies having a single driven wheel.

In the foregoing specification certain preferred practices and embodiments of this invention are set out, however, it will be obvious that this invention may be otherwise embodied within the scope of the following claims.

We claim:

1. A bridge truck assembly for cranes and the like having at least two in-line wheels on a side adapted to engage a trackway, a prime mover drivingly connected to one of said wheels, a pair of rotatable drive members engaging the circumference of both said in-line wheels between and on opposite sides of the center line between said wheels and resilient means operably connecting and acting on both said rotatable drive members urging them toward said center line and into engagement with both wheels at a selectively variable force whereby when the prime mover drives one of said wheels said one wheel drivingly engages the other wheel through said rotating members.

2. A bridge truck assembly for cranes and the like as claimed in claim 1 wherein the resilient means is a pair of springs.

3. A bridge truck assembly as claimed in claim 1 wherein the drive members are rollers journalled on spaced parallel shafts which are fixed at each end in blocks urged together by said resilient means.

4. In a bridge truck assembly or the like having a pair of in-line wheels on parallel axes and drive means acting on one of said wheels to drive it rotationally, the improvement comprising a pair of rotatable drive members engaging both said in-line wheels between them and on opposite sides of the center line between said wheels and resilient means operably connecting and acting on both said rotatable drive members urging them toward said center line and into engagement with both wheels whereby both said wheels rotate in unison with the prime mover.

5. In a bridge truck assembly as claimed in claim 4 wherein the resilient means is a pair of springs on each side of said drive members.

6. In a bridge truck assembly as claimed in claim 4 wherein the drive members are rollers journalled on spaced parallel shafts which are fixed at each end in blocks urged together by said resilient means.

* * * * *